US005400583A

United States Patent [19]

Cobb

[11] Patent Number: 5,400,583

[45] Date of Patent: Mar. 28, 1995

[54] YARN LAP PREVENTOR FOR A TAKE-UP SHAFT IN OPEN END SPINNING MACHINE

[75] Inventor: Kenneth A. Cobb, Eden, N.C.

[73] Assignee: The DE Williams Company, Charlotte, N.C.

[21] Appl. No.: 887,306

[22] Filed: May 22, 1992

[51] Int. Cl.[6] ..... D01H 11/00

[52] U.S. Cl. ..... 57/301; 57/400

[58] Field of Search ..... 57/400, 301, 300, 302, 57/404, 406, 407, 352, 303, 304, 305, 306; 118/245; 242/35.6 R, 18 DD, 18 R; 19/262, 264, 265; 15/256.51; 226/18

[56] References Cited

U.S. PATENT DOCUMENTS

| | | | |
|---|---|---|---|
| 901,784 | 10/1908 | Cordlingley | 19/264 |
| 1,454,316 | 5/1923 | Dover | 19/264 |
| 2,006,055 | 6/1935 | McKean | 242/19 |
| 2,096,923 | 10/1937 | Schwehn et al. | 19/264 |
| 2,789,774 | 11/1953 | Petersen et al. | 242/18 DD |
| 3,590,733 | 7/1971 | Gammeter | 118/245 |
| 3,924,397 | 12/1975 | Stahlecker et al. | 57/409 X |
| 3,981,085 | 9/1976 | Franko | 118/245 |
| 4,065,120 | 12/1977 | Imaizuma | 118/245 |
| 4,090,676 | 5/1978 | Yano et al. | 242/18 DD |
| 4,165,046 | 8/1979 | Suzuki et al. | 57/305 |
| 4,586,212 | 5/1986 | Gasser | 19/262 |
| 4,785,507 | 11/1988 | Miyazaki et al. | 19/262 |
| 4,819,302 | 4/1989 | Fukuda et al. | 19/262 |

*Primary Examiner*—Clifford D. Crowder
*Assistant Examiner*—Larry D. Worrell, Jr.
*Attorney, Agent, or Firm*—Bell, Seltzer, Park & Gibson

[57] ABSTRACT

A yarn lap preventor for mounting in an open end spinning machine to deflect a parted yarn end away from an enlarged diameter area of a rotating take-up shaft of the open end spinning machine. The yarn lap preventor is preferably integrally molded plastic including a body portion connected to a base mounting portion. The body portion of the yarn lap preventor includes a tapered edge which is positioned adjacent the enlarged diameter area of the take-up shaft. The body portion also includes a shield portion which extends along an arcuate portion of the enlarged diameter area. The base mounting portion includes a slotted opening to facilitate mounting with an existing fastener, such as the fastening screw which secures a yarn guide eyelet mounting plate to a traverse bar. A method for preventing the accumulation of yarn laps is also disclosed which includes deflecting a parted yarn and shielding the enlarged diameter area of the take-up shaft from the parted yarn end. The method for retrofitting an existing open end spinning machine includes using an existing fastener adjacent the enlarged diameter area of the take-up shaft.

22 Claims, 2 Drawing Sheets

YARN LAP PREVENTOR FOR A TAKE-UP SHAFT IN OPEN END SPINNING MACHINE

FIELD OF THE INVENTION

The invention relates to the field of textile yarn production and, more particularly, to a device and method for reducing yarn lap on the take-up shaft of an open end spinning machine.

BACKGROUND OF THE INVENTION

A typical open end spinning machine, such as the AUTOCORO ® rotor spinning machine available from Schlafhorst of Charlotte, N.C., includes a series of individual open end spinning positions on both sides of the elongate machine. At each position, sliver is drawn from a supply can and into a rotor spinning area. The spun yarn is engaged and moved by a rotating take-up shaft, through yarn tensioning components, and is wound by a drive roll to form a yarn package.

The spinning positions on each side of the open end spinning machine share several common operating components. Among the common components are a rotating take-up shaft and a reciprocating traverse bar. At each spinning position, the take-up shaft has an enlarged diameter area for engaging and moving yarn from the spinning area. The moving yarn is directed back and forth over the enlarged diameter area by a yarn guide eyelet mounted on a plate and moved in a reciprocal motion by the traverse bar.

When a yarn parts, such as downstream of the take-up shaft, it is likely to wrap around and form an entangled mass, that is, a yarn lap, on the enlarged portion of the take-up shaft in the time before the movement of the yarn is fully stopped by operation of a stop motion. Due to the loss in production time that would result if the common take-up shaft were stopped to remove a yarn lap at only a single position, the yarn lap is instead pulled to the side of the enlarged diameter portion of the take-up shaft by the machine operator while the shaft continues to rotate.

A number of such yarn laps on the take-up shaft may accumulate at each position before the open end spinning machine is shut down for other scheduled maintenance and all of the accumulated yarn laps may then be removed. Unfortunately, an accumulation of yarn laps may require that the open end spinning machine be operated at a reduced speed, thereby resulting in decreased production efficiency. In addition, the accumulated yarn laps present a potential fire hazard.

It is known that the tendency of the yarn to part may be reduced to thereby reduce the accumulation of yarn laps between scheduled maintenance activities. For example, the use of 100% cotton, rather than a blend, may reduce the likelihood of yarn breakage; however, it is the customer who ordinarily dictates the types of yarns to be produced. In addition, attempts have been made to more precisely control the tension of the moving yarn to thereby reduce the number of yarn partings. Alternatively, the speed of the open end spinning machine may also be reduced to reduce fluctuations in yarn tension which may cause yarn partings. Unfortunately, attempts to more precisely control tension have proven unsuccessful and fail to directly address the problem. In other words, controlling the yarn tension is not effective once a yarn parting has occurred. Reducing the speed of the spinning machine reduces production efficiency and is, thus, also undesirable.

The problem of preventing the accumulation of yarn laps on the take-up shaft of an open end spinning machine has not heretofore been adequately recognized or addressed to Applicant's knowledge. Moreover, any proposed solution for preventing yarn laps must desirably take into account that there is a substantial investment in open end spinning machines and, accordingly, a solution must be compatible with these existing machines. In addition, the area of an open end spinning machine adjacent the enlarged diameter area of the rotating take-up shaft provides only very limited clearances between existing fixed and moving components, such as yarn tensioning mechanisms.

SUMMARY OF THE INVENTION

It is therefore an object of the invention to provide a yarn lap preventor and method for preventing the accumulation of yarn laps on the take-up shaft of an open end spinning machine.

It is another object of the present invention to provide a yarn lap preventor and method for installing same so that an existing open end spinning machine may be readily retrofitted to include the yarn lap preventor.

It is yet another object of the present invention to provide a yarn lap preventor which is compact so as to fit within an existing open end spinning machine in an area thereof with only limited clearances for an additional structural component.

These and other objects, features and advantages of the present invention are provided by a yarn lap preventor comprising a body portion closely associated with the enlarged diameter area of the take-up shaft of an open end spinning machine. The open end spinning machine has a rotating take-up shaft with an enlarged diameter area thereon for engaging and moving a yarn from a spinning area to a drive roll for forming a yarn package. A traverse bar is associated with the take-up shaft and carries a yarn guide eyelet mounting plate in a reciprocal motion to direct the yarn across the surface of the enlarged diameter portion to more evenly distribute wear. The yarn lap preventor also includes a mounting base portion that is preferably secured to the traverse bar so that the body portion is positioned in closely spaced apart relation from or just touching the enlarged diameter area of the rotating take-up shaft.

The body portion of the yarn lap preventor serves as deflection means for deflecting parted yarns away from the enlarged diameter area of the take-up shaft to prevent the formation of yarn laps thereon. The body portion of the yarn lap preventor preferably includes a tapered edge extending lengthwise adjacent the enlarged diameter area of the take-up shaft to deflect a parted yarn.

The body portion of the yarn lap preventor preferably includes a shield portion extending along a predetermined arcuate portion of the enlarged diameter area of said take-up shaft. The shield portion extends along a substantial portion of the length of the enlarged diameter area of the take-up shaft to shield it from parted yarns deflected by the tapered edge of the yarn lap preventor. Stated in other words, the shield portion further reduces the likelihood of parted yarns wrapping around the enlarged diameter portion of the take-up shaft. The shield portion also preferably has an arcuate shape corresponding to the adjacent enlarged diameter area of the take-up shaft.

The yarn lap preventor also includes a base mounting portion connected to the body portion. The body portion and the base mounting portion are preferably integrally molded plastic. In a preferred embodiment of the invention, the base mounting portion is connected to the traverse bar of the open end spinning machine. Accordingly, the base is provided with an opening extending therethrough to receive a fastener for securing the yarn lap preventor to the traverse bar. The opening of the base mounting portion is preferably a slotted opening extending outwardly to an edge of said mounting base portion. The slotted opening permits an existing fastener, such as a screw securing the yarn guide eyelet mounting plate to the traverse bar, to be partially removed and then resecured to attach the yarn lap preventor to the traverse bar.

Another aspect of the present invention is a method for preventing accumulation of yarn laps from parted ends of yarn on the rotating take-up shaft of an open end spinning machine during operation of the machine. More particularly, the method includes the step of upon parting of a yarn, deflecting the parted yarn away from the enlarged diameter area of the rotating take-up shaft while the take-up shaft continues to rotate. It is also preferred to shield the enlarged diameter area of the take-up shaft from the thus deflected parted yarn while the take-up shaft continues to rotate.

Yet another aspect of the present invention is a method for retrofitting an existing open end spinning machine with a yarn lap preventor according to the invention. The yarn lap preventor is first positioned on the open end spinning machine so that the body portion of the yarn lap preventor is in close association with the enlarged diameter area of the take-up shaft of the open end spinning machine. The base mounting portion of the yarn lap preventor is then secured to the open end spinning machine using an existing removable fastener adjacent the enlarged diameter area of the take-up shaft as described above.

DETAILED DESCRIPTION OF PREFERRED EMBODIMENTS

The present invention will now be described more fully hereinafter with reference to the accompanying drawings, in which a preferred embodiment of the invention is shown. This invention may, however, be embodied in many different forms and should not be construed as limited to the embodiment set forth herein. Rather, Applicant provides this embodiment so that this disclosure will be thorough and complete, and will fully convey the scope of the invention to those skilled in the art. Like numbers refer to like elements throughout.

Figures 1, 2:
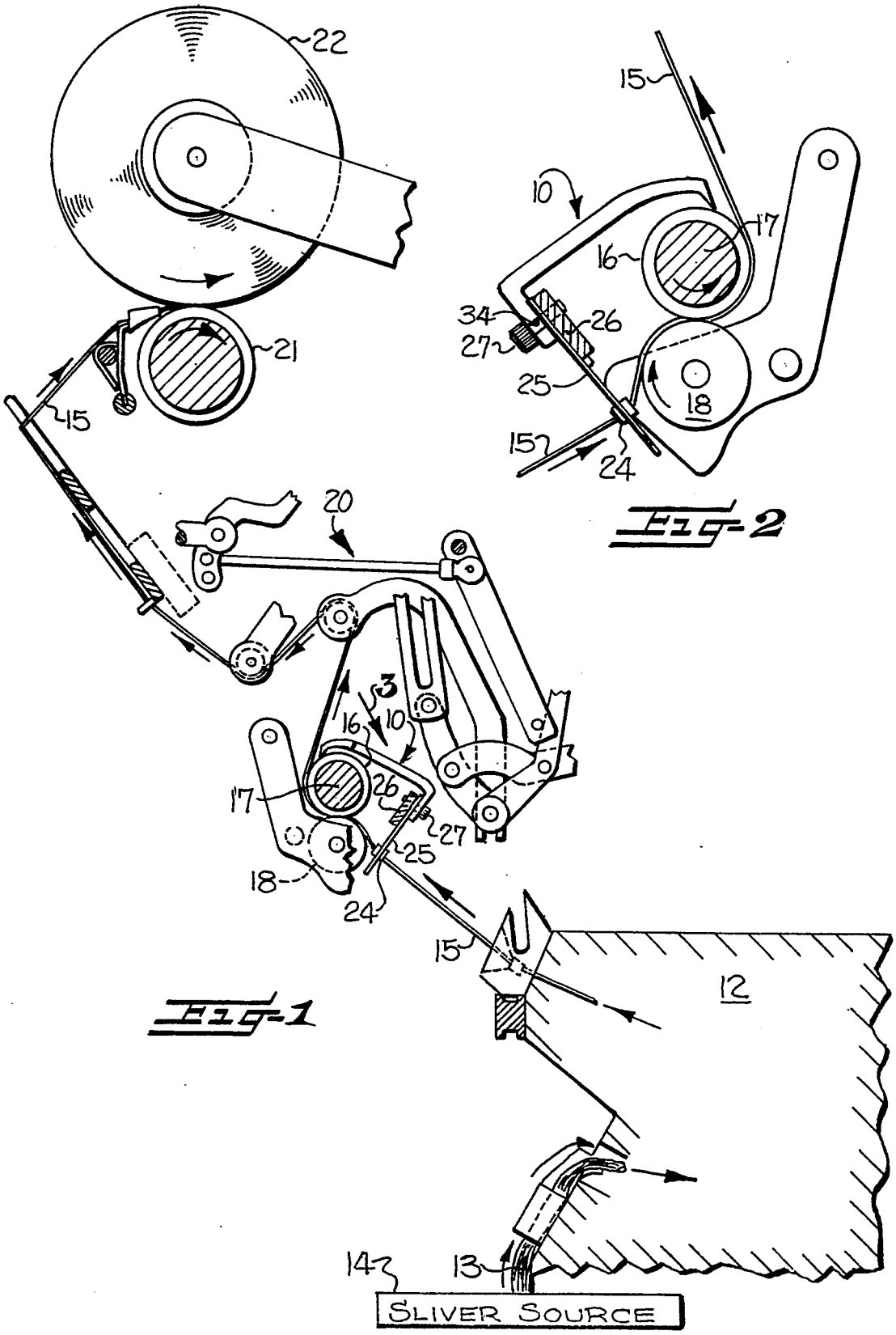
FIG. 1 is a schematic cross-sectional view of a position on an open end spinning machine including the yarn lap preventor according to the invention installed thereon.
FIG. 2 is a greatly enlarged side view of a portion of the open end spinning position shown in FIG. 1 illustrating the yarn lap preventor according to the invention.

The yarn lap preventor 10 according to the invention is shown installed in an open end spinning machine position 11 in FIG. 1. As will be readily understood by those having skill in the art, an open end spinning machine typically includes a series of such spinning positions 11 on both sides of the machine. Accordingly, the yarn lap preventor 10 is advantageously installed at each position 11 on the open end spinning machine.

As would readily be understood by those skilled in the art, an open end spinning machine includes a yarn spinning area 12 for receiving sliver 13 from a sliver source 14 and then spinning the fibers into a yarn 15. The yarn 15 from the yarn spinning area 12 is directed over an enlarged diameter area 16 of a rotating take-up shaft 17 between the enlarged diameter area and an opposing rotating cot 18. The yarn 15 is directed through a conventional yarn tensioning mechanism 20, and wound onto a yarn package 22 by a conventional drive roll 21. The yarn 15, as it is drawn from the yarn spinning area 12, is moved in a reciprocal motion back and forth across the enlarged diameter area 16 of the rotating take-up shaft 17 by a yarn guide eyelet 24 attached to a mounting plate 25 to more evenly distribute wear caused by the moving yarn, as would be readily appreciated by those skilled in the art.

The yarn guide eyelet mounting plate 25 is connected to a traverse bar 26 by a screw 27 which is secured into a threaded opening of the traverse bar. The traverse bar 26 typically extends along the length of the open end spinning machine and moves in a reciprocal motion thereby serving all of the respective spinning positions 11 therealong.

As would be readily understood by those skilled in the art, the rotating take-up shaft 17 typically serves all of the spinning positions 11 on a given side of the open end spinning machine and has a respective enlarged diameter area 16 for each position. Thus, it is not typically feasible to stop the take-up shaft 17 because of a parted yarn; rather automatic splicing equipment is used to restore the parted yarn. However, a parted yarn end may readily wrap around the enlarged diameter area 16 of the rotating take-up shaft and form a yarn lap.

Prior to the present invention, a yarn lap was typically manually pulled to an adjacent area of the take-up shaft by an operator. Yarn laps thus accumulated on the take-up shaft presenting a potential fire hazard. To reduce the likelihood of an occurrence of a parted yarn, the open end spinning machine may be operated at a reduced speed; however, this reduces the overall production efficiency of the open end spinning machine.

Referring now to FIGS. 2–7, the yarn lap preventor 10 and its functions will be more fully explained. The yarn lap preventor 10 includes a base mounting portion 30 and a body portion 31 connected thereto and extending outwardly therefrom at about a right angle. The base mounting portion 30 and body portion 31 of the yarn lap preventor 10 are preferably formed as an integrally molded unit of a plastic material, such as Nylon 66, which is readily molded yet durable in service.

The body portion 31 of the yarn lap preventor 10 preferably includes a leading tapered edge 33 positioned to extend along the enlarged diameter area 16 of the take-up shaft 17, and a shield portion 32 extending around a predetermined arcuate portion of the enlarged diameter area 16. The leading edge 33 is preferably positioned in closely spaced apart relation from where the moving yarn 15 leaves the enlarged diameter area 16 of the take-up shaft 17. The tapered edge 33 deflects a parted yarn end away from the enlarged diameter area 16 of the take-up shaft 17 and thus serves as deflection means for deflecting parted yarns to thereby prevent the accumulation of yarn laps on the take-up shaft 17.

In addition to the tapered edge 33, the body portion of the yarn lap preventor 10 also includes a shield portion 32 extending lengthwise along the enlarged diameter area 16 of the take-up shaft 17. The shield portion 32 preferably has an arcuate shape substantially corresponding to the shape of the adjacent portion of the enlarged diameter area 16 of the rotating take-up shaft 17. The shield portion 32 further serves to prevent a parted yarn end from wrapping around the enlarged diameter area 16 of the take-up shaft 17.

Upon parting of a yarn, a parted yarn end would continue to move before a stop motion could sense the parting and stop the movement of the yarn. In addition, the take-up shaft 17 continues to rotate even upon parting of a yarn. Thus, without the yarn lap preventor 10 according to the invention, a parted yarn end would wrap around the enlarged diameter area 16 of the rotating take-up shaft 17, be pulled to the side by an operator, and left to accumulate until the next scheduled periodic maintenance for the open end spinning machine.

Figure 3:
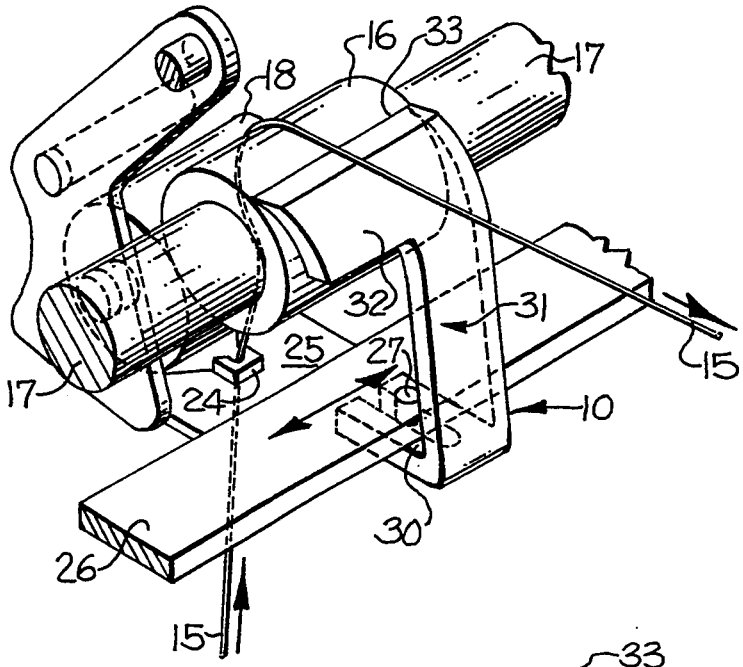
FIG. 3 is a perspective view of the portion of the open end spinning position as shown in the direction of arrow 3 in FIG. 1.
Figure 4:
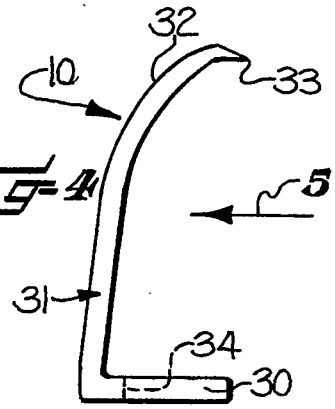
FIG. 4 is a greatly enlarged side elevational view of the yarn lap preventor according to the invention.
Figure 5:
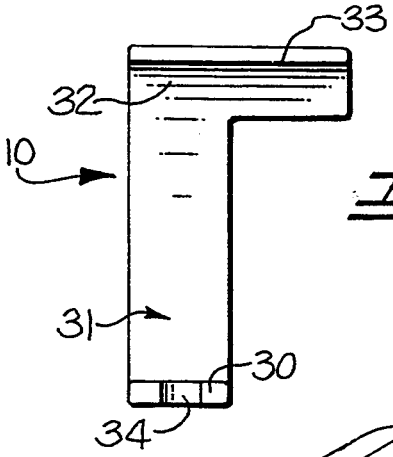
FIG. 5 is a greatly enlarged rear elevational view of the yarn lap preventor according to the invention.

As shown best in FIG. 3, the base mounting portion 30 of the yarn lap preventor 10 according to the invention is connected to the traverse bar 26 so that the tapered edge 33 is positioned in contacting relation or in closely spaced apart relation from the enlarged diameter area 16 of the rotating take-up shaft 17. As would be readily understood by those having skill in the art, the tapered edge 33 may initially be positioned in lightly contacting relation with the enlarged diameter area 16 and be abraded by frictional contact therewith resulting in the edge being positioned in closely spaced apart relation. Alternately, the tapered edge 33 may initially be positioned in closely spaced apart relation so that a parted yarn end does not pass between the enlarged diameter area 16 and the tapered edge, but rather is deflected by the tapered edge.

Figure 6:
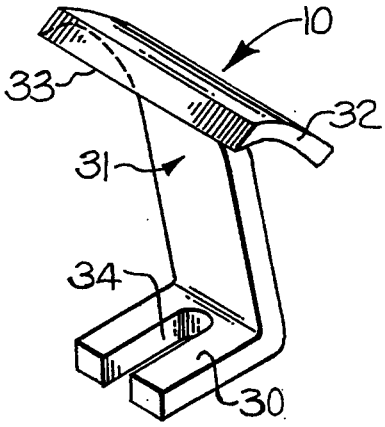
FIGS. 6 and 7 are greatly enlarged front perspective views of the yarn lap preventor according to the invention.
Figure 7:
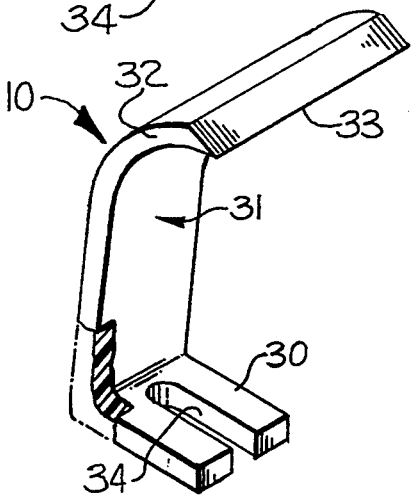

The base portion 30 of the yarn lap preventor 10 is also preferably molded to have a slotted opening 34 therein extending to an edge thereof as shown in the illustrated embodiment (FIGS. 6 and 7). Thus, another aspect of the yarn lap preventor 10 according to the present invention is that it may be readily positioned adjacent the yarn guide eyelet mounting plate 25 and secured to the traverse bar 26 by the existing fastening screw 27 which secures the yarn guide eyelet mounting plate to the traverse bar. More particularly, the screw 27 may be partially removed from the traverse bar 26 a sufficient distance to permit the slotted opening 34 of the base portion 30 to be inserted around a shaft portion of the screw 27. Accordingly, the base portion 30 of the yarn lap preventor 10 preferably has a predetermined thickness to permit it to be so inserted between a screw head portion (not shown) and the yarn guide eyelet mounting plate 25. The screw 27 may thus be used to secure the yarn lap preventor 10 to the traverse bar 26 so that the yarn lap preventor 10 moves with the traverse bar 26 along with the moving yarn back and forth across the enlarged diameter area 16 of the rotating take-up shaft 17. Thus, the yarn lap preventor 10 according to the invention is a mechanically uncomplicated device that is sufficiently compact and so designed as to be readily retrofitted to a conventional open end spinning machine using an existing removable fastener.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. In an open end spinning machine having a rotating take-up shaft with an enlarged diameter area thereon for engaging and moving a yarn from a spinning area to a drive roll for forming a yarn package, and traverse means cooperating with said take-up shaft for moving the yarn in a reciprocal manner across the enlarged diameter area of the take-up shaft, the combination therewith of deflection means connected to and carried by said traverse means for deflecting broken yarns away from the enlarged diameter area of the take-up shaft to prevent the formation of yarn laps thereon, said deflection means comprising a body portion closely associated with and overlying an upper portion of the enlarged diameter area of said take-up shaft.

2. A combination according to claim 1 wherein said body portion of said deflection means has a leading edge extending lengthwise adjacent the enlarged diameter area of said take-up shaft.

3. A combination according to claim 1 wherein said body portion of said deflection means includes a shield portion extending along a predetermined arcuate portion of the enlarged diameter area of said take-up shaft for shielding the enlarged diameter area from broken yarns.

4. A combination according to claim 3 wherein said shield portion of said body portion of said deflection means has a radius of curvature substantially corresponding to a radius of curvature of said enlarged diameter area of the take-up shaft.

5. A combination according to claim 1 wherein said traverse means comprises a yarn guide eyelet mounting plate; wherein said deflection means further comprises a base mounting portion connected to said body portion; and wherein said base mounting portion is connected to said yarn guide eyelet mounting plate.

6. A combination according to claim 5 wherein said body portion and said base mounting portion of said deflection means are integrally molded plastic.

7. A combination according to claim 5 wherein said base mounting portion of said deflection means has an opening extending therethrough; and further comprising a fastener extending through the opening of said base mounting portion for mounting said deflection means to said traverse means.

8. A combination according to claim 7 wherein said opening of said base mounting portion is a slotted opening extending outwardly to an edge of said mounting base portion.

9. A combination according to claim 7 wherein said traverse means comprises a traverse bar and a yarn guide eyelet mounting plate connected thereto; and wherein said fastener extending through the opening of said mounting base portion of said deflection means also secures the yarn guide eyelet mounting plate to said traverse bar.

10. In an open end spinning machine having open end spinning means for forming a yarn from sliver, a rotating take-up shaft with an enlarged diameter area thereon downstream from and above said open end spinning means for engaging and moving a yarn downstream from said spinning means to a yarn package drive roll for forming a yarn package, said yarn package being located above said take-up shaft, the combination therewith of deflection means connected to and carried by said open end spinning machine adjacent said enlarged diameter area of said take-up shaft for deflecting broken yarns away from the enlarged diameter area of the take-up shaft to prevent the formation of yarn laps thereon, said deflection means comprising a body portion closely associated with and overlying an upper portion of the enlarged diameter area of said take-up shaft.

11. A combination according to claim 10 wherein said body portion of said deflection means has a leading edge extending lengthwise adjacent the enlarged diameter area of the take-up shaft.

12. A combination according to claim 10 wherein said body portion of said deflection means includes a shield portion extending along a predetermined arcuate portion of the enlarged diameter area of said take-up shaft for shielding the enlarged diameter area from parted yarns.

13. A combination according to claim 10 wherein said shield portion of said body portion of said deflection means has a radius of curvature substantially corresponding to a radius of curvature of said enlarged diameter area of the take-up shaft.

14. A combination according to claim 10 wherein said deflection means further comprises a base mounting portion connected to said body portion; and wherein said base mounting portion is mounted to said open end spinning machine.

15. A combination according to claim 14 wherein said body portion and said base mounting portion of said deflection means are integrally molded plastic.

16. A combination according to claim 14 wherein said base mounting portion of said deflection means has an opening extending therethrough; and further comprising a fastener extending through said opening of said base mounting portion to secure said deflection means to said open end spinning machine.

17. A combination according to claim 16 wherein said opening of said base mounting portion is a slotted opening extending outwardly to an edge of said mounting base portion.

18. A method for preventing accumulation of yarn laps from broken ends of yarn on a rotating take-up shaft of an open end spinning machine during the operation thereof, including providing the open end spinning machine with open end spinning means for forming a yarn from a sliver and providing the rotating take-up shaft with an enlarged diameter area thereon positioned downstream from and above the open end spinning means for engaging and moving a yarn downstream from the spinning means to a yarn package drive roll for forming a yarn package positioned above the take-up shaft, the method further comprising the steps of upon breaking of a yarn, engaging the yarn above the enlarged diameter area of the rotating take-up shaft and deflecting the broken yarn away from the upper portion of the enlarged diameter area of the rotating take-up shaft; and shielding the enlarged diameter area of the take-up shaft along the upper portion thereof from the thus deflected broken yarn while the take-up shaft continues to rotate.

19. A combination according to claim 2 wherein said leading edge is positioned in closely spaced apart relation from where the moving yarn leaves the enlarged diameter area of said take-up shaft.

20. A combination according to claim 2 wherein said leading edge is tapered.

21. A combination according to claim 11 wherein said leading edge is positioned in closely spaced apart relation from where the moving yarn leaves the enlarged diameter area of said take-up shaft.

22. A combination according to claim 11 wherein said leading edge is tapered.

* * * * *